US007980882B2

(12) United States Patent
Hetzer et al.

(10) Patent No.: US 7,980,882 B2
(45) Date of Patent: Jul. 19, 2011

(54) ELECTRICAL PLUG RECEIVING CONNECTOR

(75) Inventors: Ulrich Hetzer, Berlin (DE); Frank Mossner, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/522,952

(22) PCT Filed: Dec. 13, 2007

(86) PCT No.: PCT/EP2007/010933

§ 371 (c)(1),
(2), (4) Date: Jul. 13, 2009

(87) PCT Pub. No.: WO2008/086865

PCT Pub. Date: Jul. 24, 2008

(65) Prior Publication Data

US 2010/0003847 A1 Jan. 7, 2010

(30) Foreign Application Priority Data

Jan. 18, 2007 (DE) ..... 10 2007 002 767

(51) Int. Cl.
*H01R 4/24* (2006.01)
*H01R 4/26* (2006.01)

(52) U.S. Cl. ..... 439/404; 439/620.22; 439/676

(58) Field of Classification Search ..... 439/404, 439/405, 676, 941, 76.1, 620.22
See application file for complete search history.

(56) References Cited

U.S. PATENT DOCUMENTS 5,228,872 A 7/1993 Liu
5,951,330 A 9/1999 Reichard, Jr. et al.
5,975,936 A 11/1999 Lin et al.
5,989,071 A 11/1999 Larsen et al.
6,010,353 A 1/2000 Ensz et al.
6,050,842 A 4/2000 Ferrill et al.
6,126,476 A 10/2000 Viklund et al.
6,213,809 B1 4/2001 Viklund
6,238,231 B1 5/2001 Chapman et al.
6,305,950 B1 10/2001 Doorhy
6,358,093 B1 3/2002 Phommachanh et al.
6,371,793 B1 4/2002 Doorhy
6,371,794 B1 4/2002 Bauer et al.
6,648,670 B1 11/2003 Chen
6,796,847 B2 * 9/2004 AbuGhazaleh et al. ..... 439/676
6,953,362 B2 10/2005 Mossner et al.
7,591,654 B2 9/2009 Neumetzler
7,798,866 B2 9/2010 Hetzer et al.
2005/0136747 A1 6/2005 Caveney et al.

(Continued)

FOREIGN PATENT DOCUMENTS

DE 43 14 908 11/1993

(Continued)

*Primary Examiner* — Michael C Zarroli
(74) *Attorney, Agent, or Firm* — Merchant & Gould P.C.

(57) ABSTRACT

The invention relates to an electrical plug-in connector (1) for telecommunications and data systems technology, comprising electrically interconnected elastic high-frequency contacts (4) and core connection contacts (10). At least the high-frequency contacts (4) are arranged in a housing (2) comprising a receiving opening (3) for a counter plug-in connector, and the core connection contacts (10) are arranged in two parallel rows (8, 9). The distance between adjacent core connection contacts of a row is smaller than that between core connection contacts of different rows. The housing (2) has an upper edge (5), a lower edge (6) and two lateral edges (7), the two rows (8, 9) of core connection contacts (10) being parallel to the upper edge (5) of the housing (2).

10 Claims, 4 Drawing Sheets

U.S. PATENT DOCUMENTS

| | | | |
|---|---|---|---|
| 2005/0202697 | A1 | 9/2005 | Caveney et al. |
| 2007/0111555 | A1 | 5/2007 | Neumetzler |
| 2010/0041250 | A1 | 2/2010 | Hetzer et al. |
| 2010/0075530 | A1 | 3/2010 | Hetzer et al. |

FOREIGN PATENT DOCUMENTS

| | | |
|---|---|---|
| DE | 102 57 308 | 7/2004 |
| DE | 20 2005 001 178 | 1/2005 |
| DE | 103 33 913 | 2/2005 |
| EP | 0 899 823 | 3/1999 |
| EP | 0 899 827 | 3/1999 |
| EP | 0 899 828 | 3/1999 |
| EP | 0 923 171 | 6/1999 |
| EP | 0 969 569 | 1/2000 |
| EP | 0 982 815 | 3/2000 |
| EP | 1 312 137 | 5/2005 |
| EP | 1 622 234 | 2/2006 |
| TW | M269631 | 11/2004 |
| TW | M301448 | 11/2006 |
| WO | WO 01/80376 | 10/2001 |
| WO | WO 01/82418 | 11/2001 |
| WO | WO 02/15340 | 2/2002 |
| WO | WO 2005/064755 | 7/2005 |
| WO | WO 2005/101579 | 10/2005 |

* cited by examiner

ELECTRICAL PLUG RECEIVING CONNECTOR

This application is a National Stage Application of PCT/EP2007/010933, filed 13 Dec. 2007, which claims benefit of Serial No. 10 2007 002 767.4, filed 18 Jan. 2007 in Germany and which applications are incorporated herein by reference. To the extent appropriate, a claim of priority is made to each of the above disclosed applications.

BACKGROUND

Such a generic electrical plug-in connector is previously known, for example, from EP 1 312 137 B1. Here, the wire connection contacts are formed by two rows of insulation displacement contacts, which are arranged parallel to the side edges of the plug-in connector on its rear side.

DE 20 2005 001 178 U1 has further disclosed an RJ45 socket, in which the two rows of insulation displacement contacts are arranged on the upper side of the plug-in connector, the rows in each case being positioned at a right angle with respect to the upper edge, lower edge and the side edges.

Owing to the gap required between the two rows, the plug-in connector is relatively wide, which limits the number of plug-in connectors which can be installed when installing the plug-in connectors in internals with fixed dimensions such as 19" panels.

SUMMARY

The invention is therefore based on the technical problem of providing a plug-in connector which can be designed to be narrower in terms of its width dimensions.

In this regard, the electrical plug-in connector comprises sprung RF contacts and wire connection contacts, the RF contacts and the wire connection contacts being electrically connected to one another, at least the RF contacts being arranged in a housing, which has a receiving opening for a mating plug-in connector, and the wire connection contacts being arranged in two parallel rows, adjacent wire connection contacts in one row having a smaller gap than wire connection contacts in different rows, the housing having an upper edge, lower edge and two side edges, the two rows of wire connection contacts being arranged parallel to the upper edge of the housing. This means that it is not necessary for the gap between the rows to be altered, which has the advantage that the conventional connection tools for connecting the wire connection contacts can still be used. In order to reduce the width, the wire connection contacts in one row then only need to be brought together slightly. This allows for a narrower design of the plug-in connector. In this case, preferably only the gap between different contact pairs is reduced.

In one preferred embodiment, the wire connection contacts are in the form of insulation displacement contacts.

In a further preferred embodiment, wire connection contacts in a row which are associated with one another in pairs are aligned parallel to one another, whereas adjacent wire connection contacts of different contact pairs in a row are arranged with respect to one another such that they are rotated through 90° about the longitudinal axis of the wire connection contacts. As a result, the capacitive coupling between adjacent contact pairs is reduced which was increased by the reduction in the gap. In this case, the gap b or b' between contacts of one contact pair is preferably smaller than the gap c or c' between contacts of different contact pairs.

In a further preferred embodiment, opposite wire connection contacts of different rows are arranged with respect to one another such that they are rotated through 90° about the longitudinal axis of the wire connection contacts. As a result, the capacitive coupling between the contacts of different rows is reduced, which also reduces crosstalk.

In a further preferred embodiment, the RF contacts and the wire connection contacts are arranged on a common printed circuit board.

In a further preferred embodiment, the longitudinal axes of the wire connection contacts are aligned parallel to the surface of the printed circuit board.

In a further preferred embodiment, the wire connection contacts are connected to the printed circuit board via SMD-like contacts.

In a further preferred embodiment, the electrical plug-in connector is in the form of an RJ45 socket.

BRIEF DESCRIPTION OF THE DRAWINGS

The invention will be explained in more detail below with reference to a preferred exemplary embodiment. In the figures.

DETAILED DESCRIPTION

Figure 1:
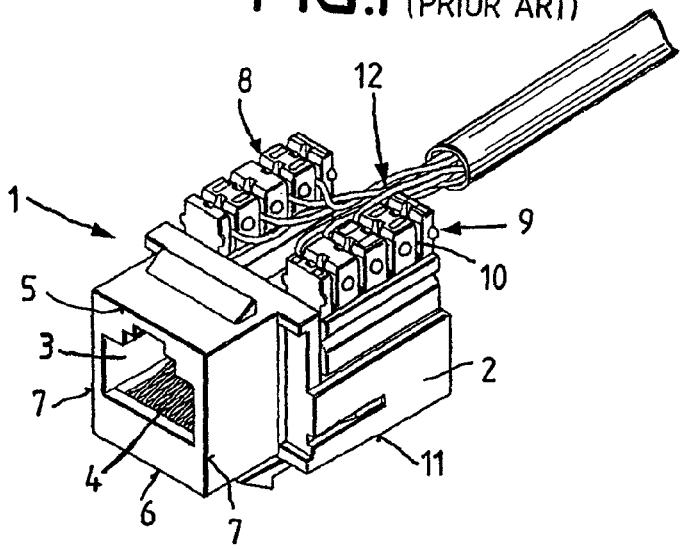
FIG.1 (PRIOR ART)
FIG. 1 shows a perspective illustration of an RJ45 socket in a first embodiment (prior art in accordance with DE 20 2005 001 178 U1)

FIG. 1 illustrates an RJ45 socket in accordance with the prior art as an electrical plug-in connector 1. The plug-in connector 1 comprises a housing 2, which has a receiving opening 3, in which RF contacts 4 are arranged with which contact can be made by a mating plug. The housing has an upper edge 5, a lower edge 6 and two side edges 7. Two rows 8, 9 of wire connection contacts 10 which are in the form of insulation displacement contacts, are arranged on the upper side of the plug-in connector 1. In this case, the two rows extend parallel to a longitudinal edge 11 of the plug-in connector. In this case, the two rows 8, 9 have a predefined gap which makes it possible to push wires 12 into the wire connection contacts 10 using a connection tool.

Figure 2:
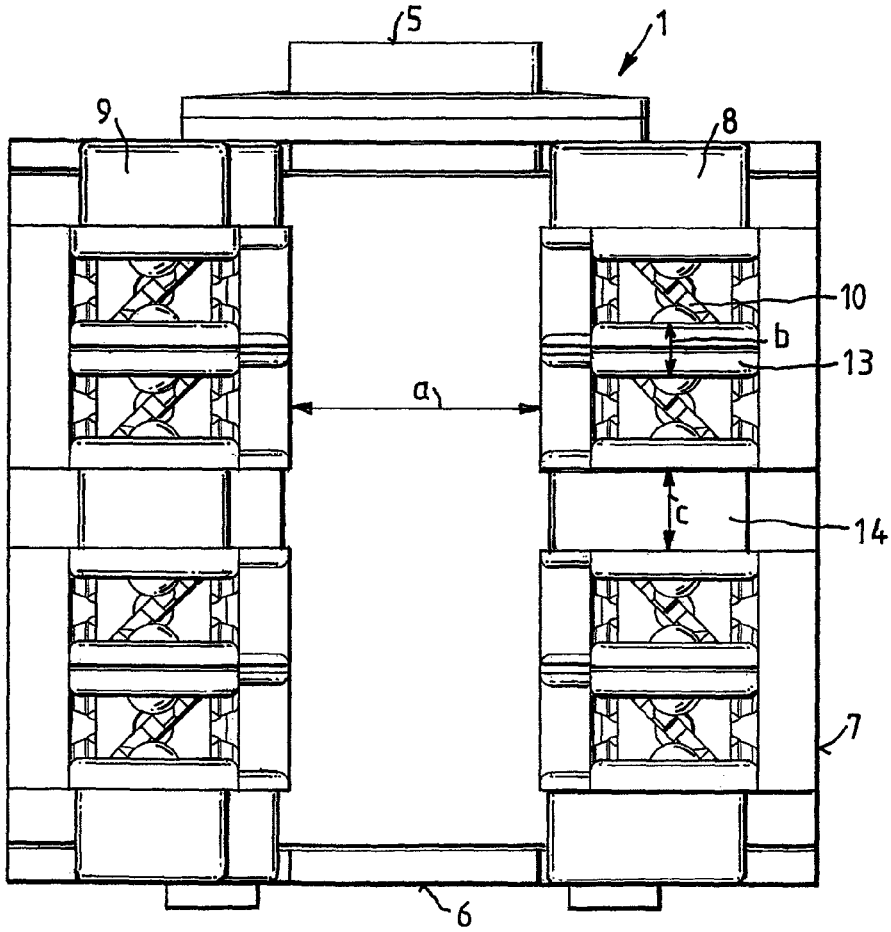
FIG.2 (PRIOR ART)
FIG. 2 shows a rear view of an RJ45 socket in accordance with a further embodiment (prior art)

FIG. 2 illustrates an alternative design in accordance with the prior art. In this case, the two rows 8, 9 are not arranged on the upper side of the plug-in connector, but on the rear side. In this case, the two rows 8, 9 are arranged parallel to the side edges and at a right angle to the upper edge 5. Mention will be made here of the fact that the upper edge 5, lower edge 6 and side edges 7 illustrated in FIG. 1 do not correspond to the edges shown in the illustration in FIG. 2, since these are two different designs and the visible edges of the front and rear side differ from one another. However, this is not critical since it is only the parallelism with respect to the edges that is important.

The gap a between the rows 8 and 9 is in this case dimensioned such that the wire connection contacts 10 can be connected by a connection tool. Furthermore, it can be seen that all four wire connection contacts 10 in a row 8, 9 are aligned parallel to one another, the wire connection contacts 10 in the form of insulation displacement contacts being set at an angle of 45° with respect to the ribs 13. Each row 8, 9 comprises four wire connection contacts 10, which are each associated with one another in pairs, the wire connection contacts 10 of an associated pair being separated from one another by a rib 13, adjacent wire connection contacts 10 of different pairs being spaced apart from one another by a wide web 14. As can be seen, in this case the width c of the web 14 is larger than the width b of the rib 13. Owing to the large gap between the wire connection contacts 10 of different contact pairs, crosstalk is reduced in this case.

Figure 3:
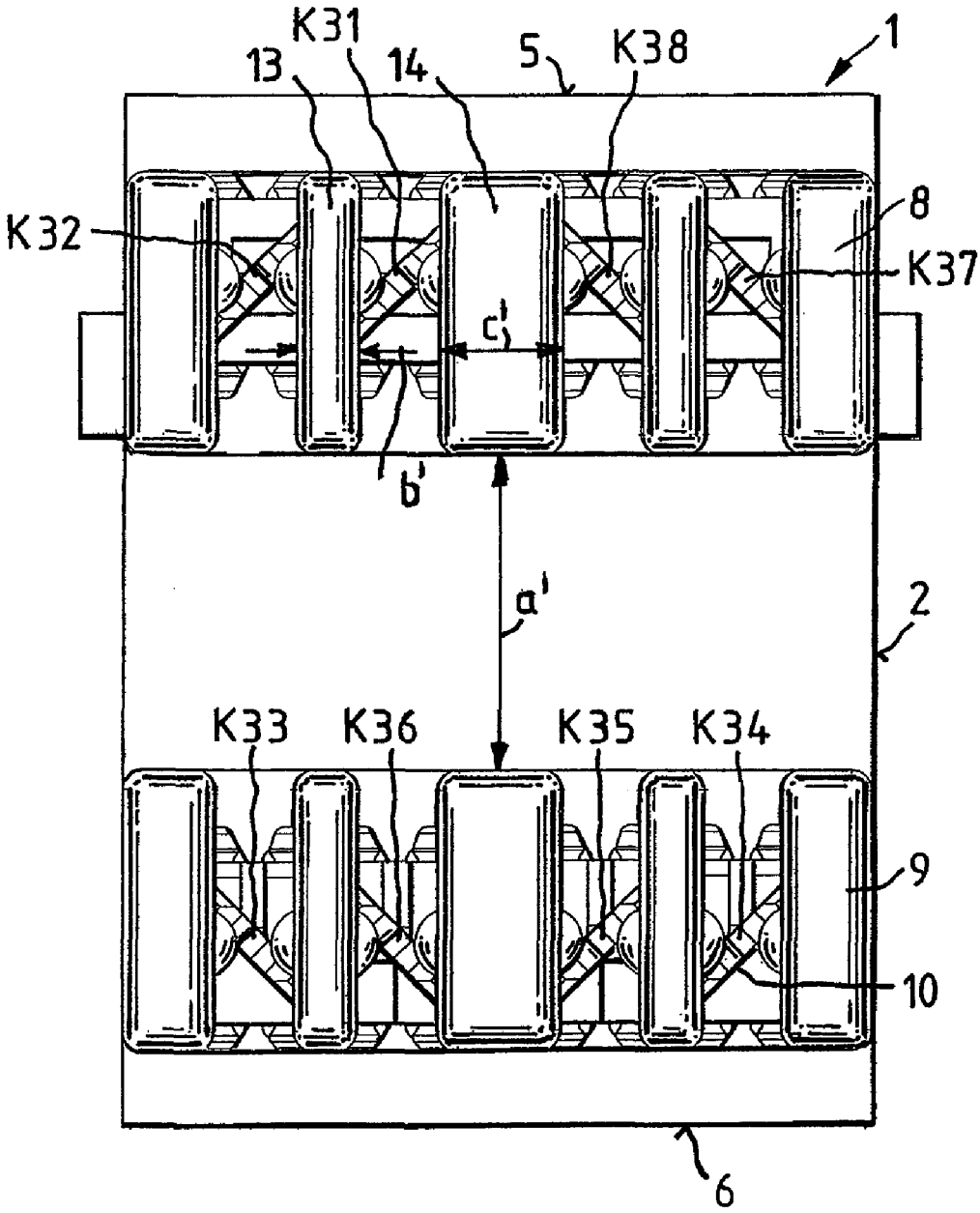
FIG. 3 shows a rear view of a plug-in connector according to the invention.

FIG. 3 now illustrates the plug-in connector 1 according to the invention in a rear view. In this case, the rows 8, 9 are now aligned parallel to the upper edge 5, it being possible for the width b' of the ribs 13 and/or the width c' of the web 14 to be selected to be smaller than the width b or c shown in FIG. 2. In this case, the web 14 also at the same time forms a rib for the insulation displacement contacts. The reduction in the width b' and/or c' can be used directly for making the plug-in connector 1 narrower. The gap a' between the rows 8 and 9 is in this case selected to be at least as large as the gap a shown in FIG. 2, in order that connection is still possible using an attachment tool. The associated wire connection contacts 10 of one contact pair in a row 8, 9 are in this case again aligned parallel with respect to one another. In contrast to FIG. 2, however, adjacent wire connection contacts in a row 8 or 9, which do not belong to the same contact pair, are now arranged such that they are rotated through 90° about the longitudinal axis of the wire connection contacts 10. The capacitive coupling between these contacts is therefore reduced. It can further be seen that opposite wire connection contacts 10 of different rows 8, 9 are also arranged with respect to one another such that they are rotated through 90° about the longitudinal axis of the wire connection contacts 10. This reduces the capacitive coupling and therefore the crosstalk between the wire connection contacts of different rows 8, 9.

Figure 4A:
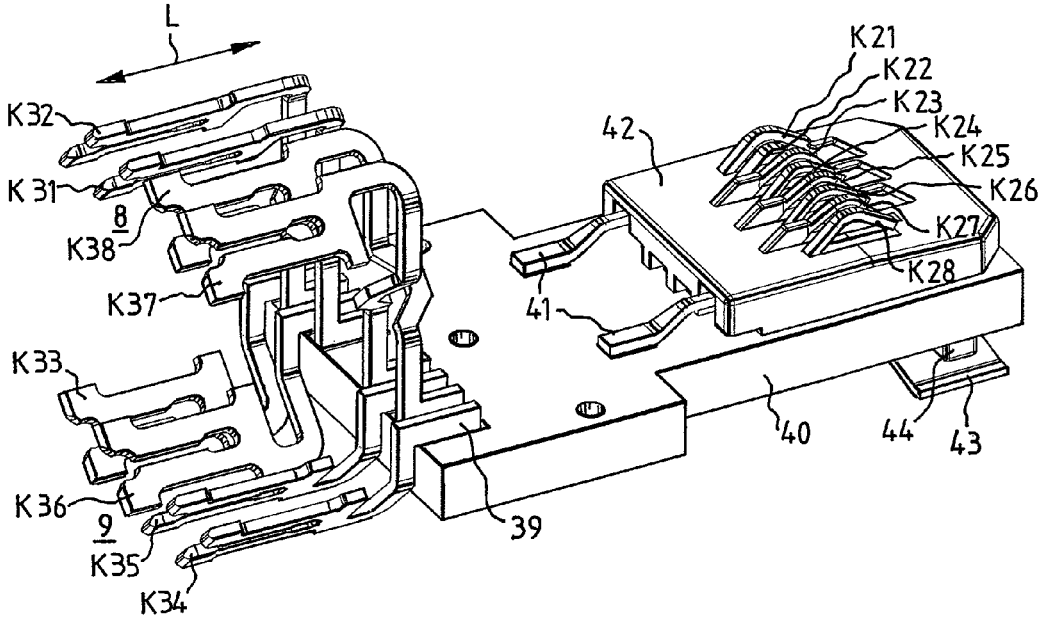
FIG. 4*a* shows a perspective illustration of a plug-in connector according to the invention without a housing.
Figure 4B:
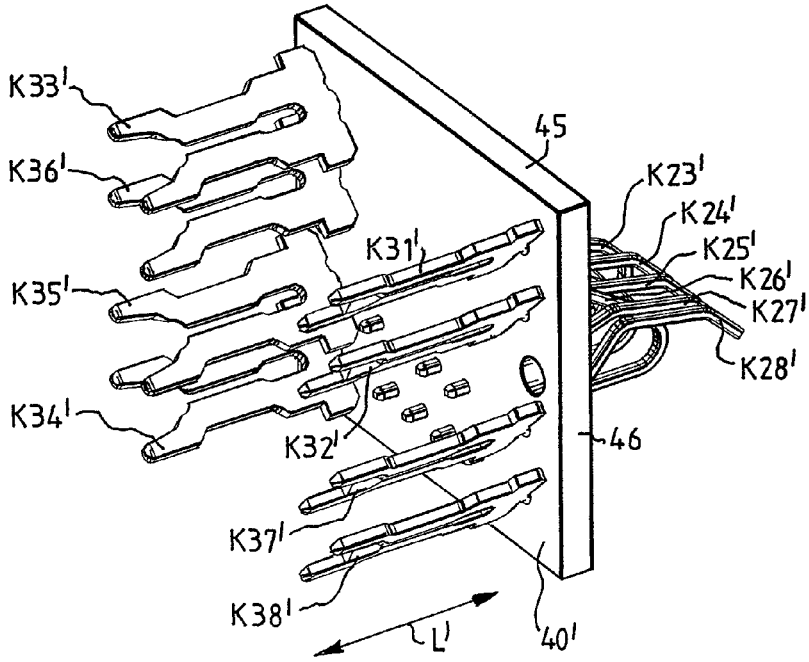
FIG.4b (PRIOR ART)
FIG. 4*b* shows a perspective illustration of a plug-in connector as shown in FIG. 2 without a housing (prior art)

FIG. 4*a* illustrates the plug-in connector 1 shown in FIG. 3 in a perspective view without a housing. Correspondingly, the plug-in connector 1 shown in FIG. 2 is illustrated in a perspective illustration without a housing in FIG. 4*b*. In this case, similar elements are provided with the same reference numerals, the elements in accordance with the prior art also being identified by a' in FIG. 4*b*. The plug-in connector 1 comprises eight insulation displacement contacts K31-K38, which are each combined in pairs. In this case, K31, K32; K33, K36; K34, K35 and K37, K38 each form a contact pair.

The insulation displacement contacts K31, K32, K37, K38 in this case form row 8 (see FIG. 3), and the insulation displacement contacts K33-K36 form the row 9 (see FIG. 3). The insulation displacement contacts K31-K38 are connected to the printed circuit board 40 via SMD-like contacts 39. The RF contacts K21-K28 are arranged in the front region of the printed circuit board 40. The RF contacts K21-K28 are likewise connected to the printed circuit board 40 via SMD-like contacts 41. As can be seen particularly well in FIG. 5, the insulation displacement contacts K31, K32, K37, K38 are arranged at a greater distance from the printed circuit board 40 and therefore the contact length to the printed circuit board 40 is greater. In order to compensate for this greater contact length, the connections of the insulation displacement contacts K31, K32 or K37, K38 to the printed circuit board 40 are crossed over. It can further be seen that the longitudinal axes L of the insulation displacement contacts K31-K38 lie parallel to the surface of the printed circuit board 40. Furthermore, it can clearly be seen that the insulation displacement contacts of one contact pair are in each case aligned parallel to one another, whereas adjacent insulation displacement contacts (for example K31 and K38) of different pairs in a row are arranged with respect to one another such that they are rotated through 90° about the longitudinal axis L. The same applies for the perpendicularly opposite insulation displacement contacts of different rows (for example K32 and K33). The RF contacts K21-K28 are prestressed and guided by a comb element 42. In this case, the inner RF contacts K22-K27 are bent alternately in each case towards one another. The two outer RF contacts K21, K28, on the other hand, are designed to be mechanically longer, whereby they have a short, electrically effective contact point where the RF contact K21, K28 rests in a sprung manner against a contact point on the printed circuit board 40. This electrical contact point is positioned beneath the comb element 42 and is therefore not visible.

Furthermore, beneath the printed circuit board 40 a spring-elastic element 43 can be seen which elastically prestresses the printed circuit board 40 via an intermediate piece 44. Tolerances of the housing and the mating plug-in connector can be compensated for via this spring-elastic excursion movement of the printed circuit board 40 with the result that the RF contacts K21-K28 may be designed to be shorter. In order now to prevent any reactions of an excursion movement of the printed circuit board 40 on the connection to the SMD-like contacts 39, the housing is preferably designed to have two parts, the housing part which accommodates the insulation displacement contacts K31-K38 being connected to the other housing part such that it can move, which other housing part defines the receiving opening for the mating plug-in connector. The printed circuit board 40 is in this case mounted fixedly in the housing part of the insulation displacement contacts K31-K38.

Figure 5:
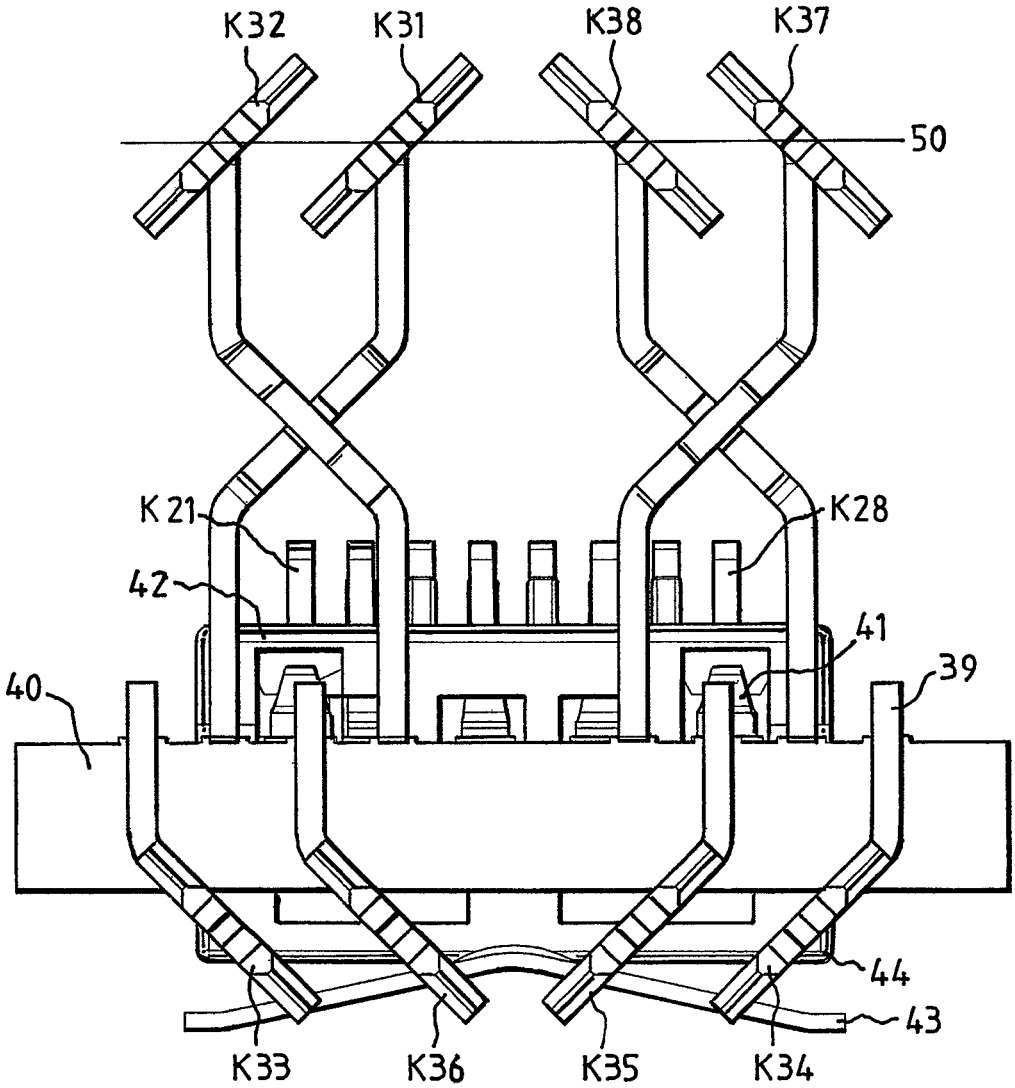
FIG. 5 shows a rear view of the plug-in connector shown in FIG. 4*a*.

In contrast to the embodiment shown in FIG. 4*a*, the longitudinal axis L' of the insulation displacement contacts K31'-K38' is at right angles to the surface of the printed circuit board 40'. Furthermore, the insulation displacement contacts K31'-K38' are connected to the printed circuit board 40 via soldering pins, in the same manner as the RF contacts K21'-K28', which are not all visible, however. Since, in the embodiment shown in FIG. 4*b*, the end face 45 is parallel to the upper edge 5 of the housing, it can be seen that the row which is formed by the insulation displacement contacts K31', K32', K37' and K38' or the row which is formed by the insulation displacement contacts K33'-K36' is at right angles to the upper edge 5 and parallel to the side edge or face 46 of the printed circuit board 40'. In contrast to this, the rows in the embodiment shown in FIG. 4*a* are aligned parallel to the upper edge 5 (see FIG. 3). In order to further clarify the term row, a virtual line 50 is illustrated in FIG. 5 which corresponds to the orientation of the row 8 shown in FIG. 3. Finally, it shall once again be made clear that the insulation displacement contacts K31-K38 and the RF contacts K21-K28 having the same indices are connected electrically to one another at the end (i.e. K35 to K25, for example), preferably via conductor tracks on the printed circuit board 40.

LIST OF REFERENCE SYMBOLS

1 Plug-in connector
2 Housing
3 Receiving opening
4 RF contacts
5 Upper edge
6 Lower edge
7 Side edge
8, 9 Rows

10 Wire connection contacts
11 Longitudinal edge
12 Wires
13 Rib
14 Web
K21-K28 RF contacts
K21'-K28' RF contacts
K31-K38 Insulation displacement contacts
K31'-K38' Insulation displacement contacts
39 SMD-like contacts
40, 40' Printed circuit board
41 SMD-like contacts
42 Comb element
43 Spring-elastic element
44 Intermediate piece
45 End face
46 Side edge or face
50 Virtual line
L, L' Longitudinal axis
a, a' Gap between two rows
b, b' Width of rib
c, c' Width of web

The invention claimed is:

1. An electrical plug receiving connector for telecommunications and data technology, comprising:

a housing having an upper edge, a lower edge, and two side edges, the housing defining an opening for receiving an electrical plug connector along an insertion axis;

sprung RF contacts arranged in the opening of the housing to mate with the electrical plug connector, the RF contacts being arranged in a row extending parallel to the upper and lower edges of the housing, and wire connection contacts arranged in two parallel rows extending parallel to the upper and lower edges of the housing, each wire connection contact having a longitudinal axis that extends generally parallel to the insertion axis, wherein a first gap between adjacent wire connection contacts in each row is smaller than a second gap between opposite wire connection contacts in different rows, wherein each wire connection contact in a first of the rows crosses-over another of the wire connection contacts in the first row to form crossed-over wire connection contacts and wherein each wire connection contact in a second of the rows extends generally parallel to each other.

2. The electrical plug receiving connector as claimed in claim 1, wherein the wire connection contacts are in the form of insulation displacement contacts.

3. The electrical plug receiving connector as claimed in claim 1, wherein wire connection contacts in each row which are associated with one another in pairs are aligned parallel to one another, whereas adjacent wire connection contacts of different pairs in each row are arranged with respect to one another such that each wire connection contact is rotated through 90° about the longitudinal axis of the wire connection contact.

4. The electrical plug receiving connector as claimed in claim 1, wherein opposite wire connection contacts of different rows are arranged with respect to one another such that each wire connection contact is rotated through 90° about the longitudinal axis of the wire connection contact.

5. The electrical plug receiving connector as claimed in claim 1, wherein the RF contacts and the wire connection contacts are arranged on a common printed circuit board.

6. The electrical plug receiving connector as claimed in claim 5, wherein the longitudinal axes of the wire connection contacts are aligned parallel to a surface of the printed circuit board.

7. The electrical plug receiving connector as claimed in claim 5, wherein the wire connection contacts are connected to the printed circuit board via SMD-like contacts.

8. The electrical plug receiving connector as claimed in claim 1, wherein the electrical plug receiving connector is in the form of an RJ45 socket.

9. The electrical plug receiving connector as claimed in claim 5, wherein a first of the rows of the wire connection contacts is located closer to the printed circuit board than a second of the rows.

10. The electrical plug receiving connector as claimed in claim 9, wherein the first row is located farther from the printed circuit board than the second row.

* * * * *